United States Patent [19]

Blengini

[11] Patent Number: 4,760,798

[45] Date of Patent: Aug. 2, 1988

[54] DEVICE FOR THE AUTOMATIC CONNECTION OF A VEHICLE TO THE CABLE OR TO EACH OF THE TWO CABLES OF A CONTINUOUSLY MOVING CABLEWAY

[75] Inventor: Sergio Blengini, Mondovi, Italy

[73] Assignee: Agudio S.p.A., Leini, Italy

[21] Appl. No.: 16,898

[22] Filed: Feb. 20, 1987

[30] Foreign Application Priority Data

Feb. 21, 1986 [IT] Italy ..... 67134 A/86

[51] Int. Cl.[4] ..... B61B 12/12

[52] U.S. Cl. ..... 104/209; 104/211; 104/214

[58] Field of Search ..... 104/173.1, 173.2, 202, 104/204, 209, 211, 214, 217

[56] References Cited

U.S. PATENT DOCUMENTS

| | | | |
|---|---|---|---|
| 905,217 | 12/1908 | Ofstad | 104/217 |
| 2,724,343 | 11/1955 | Dumur | 104/102 X |
| 3,857,340 | 12/1974 | Wright | 104/209 X |
| 4,120,247 | 10/1978 | Müller et al. | 104/173.2 X |
| 4,641,585 | 2/1987 | Tarassoff | 104/211 X |
| 4,653,406 | 3/1987 | Levi | 104/209 X |

FOREIGN PATENT DOCUMENTS

| | | | |
|---|---|---|---|
| 1453517 | 8/1966 | France | 104/209 |
| 367200 | 3/1963 | Switzerland | 104/211 |
| 676486 | 7/1979 | U.S.S.R. | 104/202 |

*Primary Examiner*—Carlton R. Croyle

*Assistant Examiner*—Paul F. Neils

*Attorney, Agent, or Firm*—Sughrue, Mion, Zinn, Macpeak, & Seas

[57] ABSTRACT

A device for the automatic connection of a vehicle to the cable of a continuously moving cableway comprises a clamp which is constituted by two jaws, an inner one and an outer one, carried by the upper end of the vehicle suspension system, and which is arranged to close automatically to engage the cable under the action of resilient member and a cam located at each station for automatically and opening the clamp simultaneously loading the resilient member, so as to cause the temporary unhooking of the vehicle from the cable on its arrival at the station and the closure of the clamp on the departure of the vehicle from the station. The outer jaw is carried by an operating lever hinged at one end to a support member and having its other end subject directly to the action of the cam located at each station. The pivoting of the operating lever causes the opening of the clamp and causes the simultaneous loading of a helical spring wound around a shank of the operating lever by a movable plate slidable on the shank and fixed to a pin which slides in a longitudinal slot in the operating lever and in two cam slots of the support member. The inner jaw is carried by an intermediate lever interposed between the operating lever and the support member and pivoted at one end to the support member. The movement of this intermediate lever is effected by the pin which is slidable in the operating lever and engages two cam slots formed in this intermediate lever.

2 Claims, 3 Drawing Sheets

Figure 1:
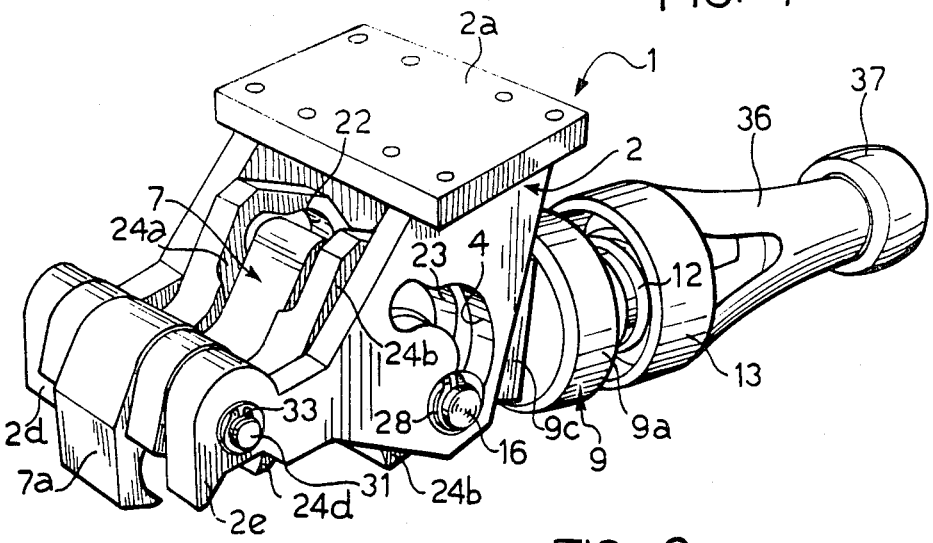

DEVICE FOR THE AUTOMATIC CONNECTION OF A VEHICLE TO THE CABLE OR TO EACH OF THE TWO CABLES OF A CONTINUOUSLY MOVING CABLEWAY

The present invention relates to devices for the automatic connection of a vehicle to the cable or to each of the two cables of a continuously moving cableway.

The device of the present invention is of the type comprising a clamp constituted by two movable jaws, an inner one and an outer one, carried by the upper end of the suspension system for the car, the clamp being arranged to close automatically to engage the cable under the action of resilient means and cam means located at each station for automatically opening the clamp and simultaneously loading the resilient means, so as to cause the temporary unhooking of the vehicle from the cable on its arrival at the station and the closure of the clamp on the departure of the vehicle from the station.

A device of the type described above is illustrated in Italian utility model application No. 23472-B/84 filed by the same applicant.

The device described in the aforesaid document is structurally complex and bulky, and also has the disadvantage of requiring high operating forces for opening and closing the clamp.

The object of the present invention is to overcome these disadvantages. This object is achieved according to the invention by a device of the type defined above, characterised in that:

the outer movable jaw is carried by an operating lever pivoted on a support member and operated directly by the cam means located at the station, the operating lever carries, at its end opposite that carrying the outer movable jaw, a cylindrical shank on which is mounted a helical spring reacting at one end against a fixed plate and at its other end against a movable plate slidable on the shank and fixed to a fork which supports a pin slidable in an axial slot in the operating lever, so that the pivoting of the operating lever in the sense corresponding to opening of the clamp, which is driven by the cam means at the station, causes the simultaneous outward pivoting of the respective jaw and loading of the spring, the ends of the pin engage in respective cam slots carried by two parallel plates forming part of the support member and arranged to be fixed to the support structure of the vehicle, the inner movable jaw of the clamp is constituted by two aligned half-jaws carried by two plates forming part of an intermediate rocker arm pivoted on the support member on the same pin as that on which the operating lever is pivoted and located between the operating lever and the two plates of the support member;

the two plates of the intermediate lever are each provided with a cam slot through which the pin passes and which has a shape concordant with that of the slots of the support member.

Figure 2:
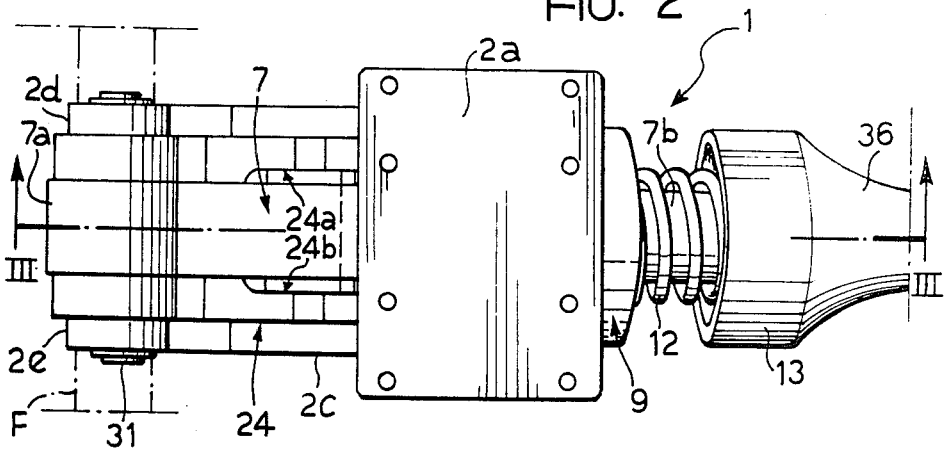
Figure 4:
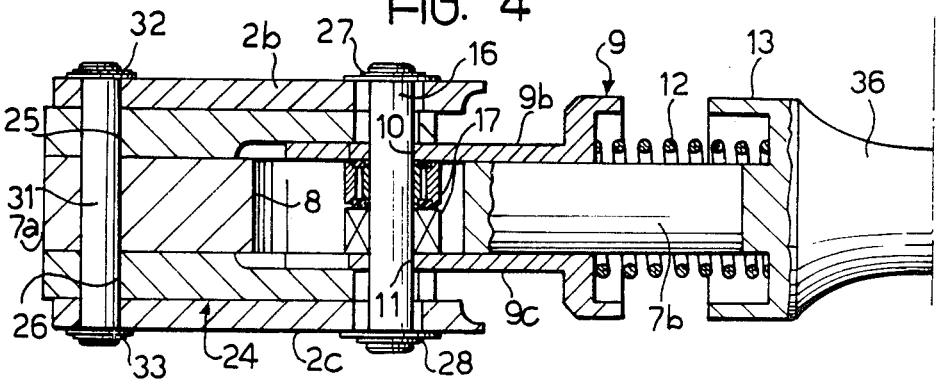
Figure 3:
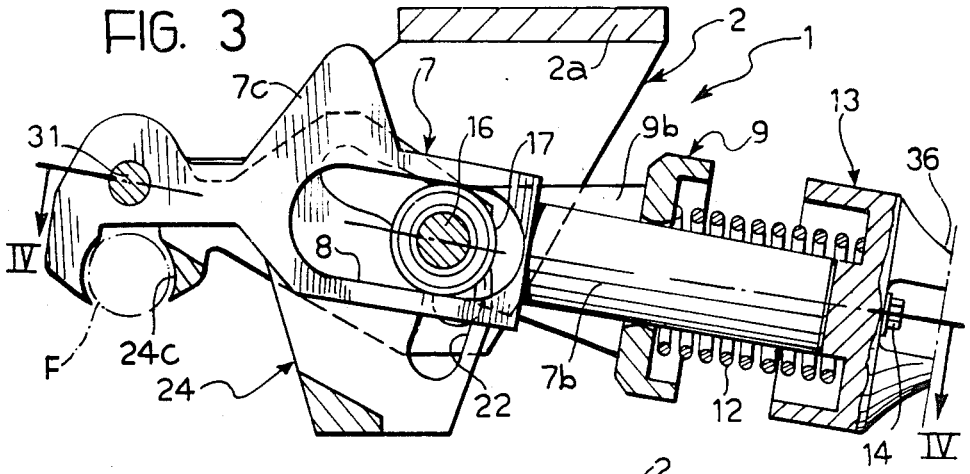
Figure 6:
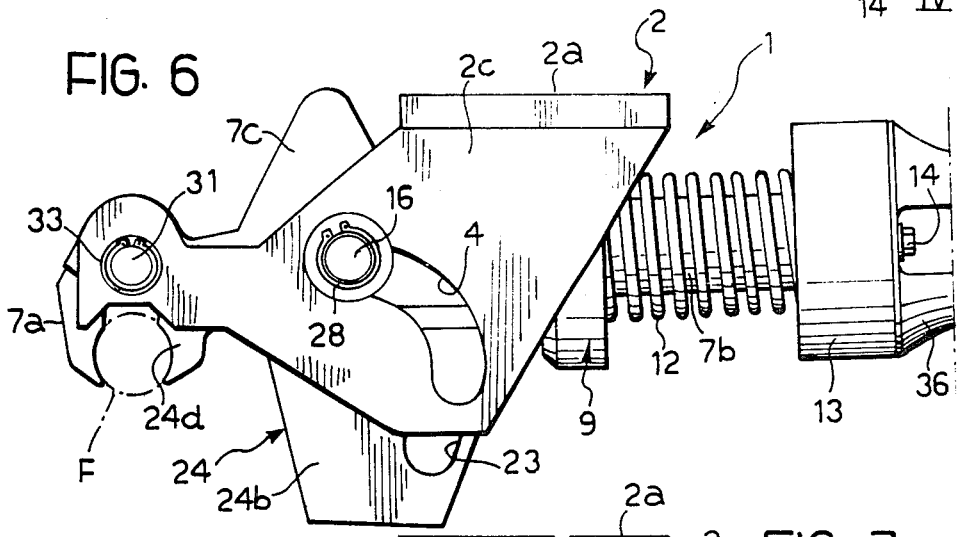
Figure 7:
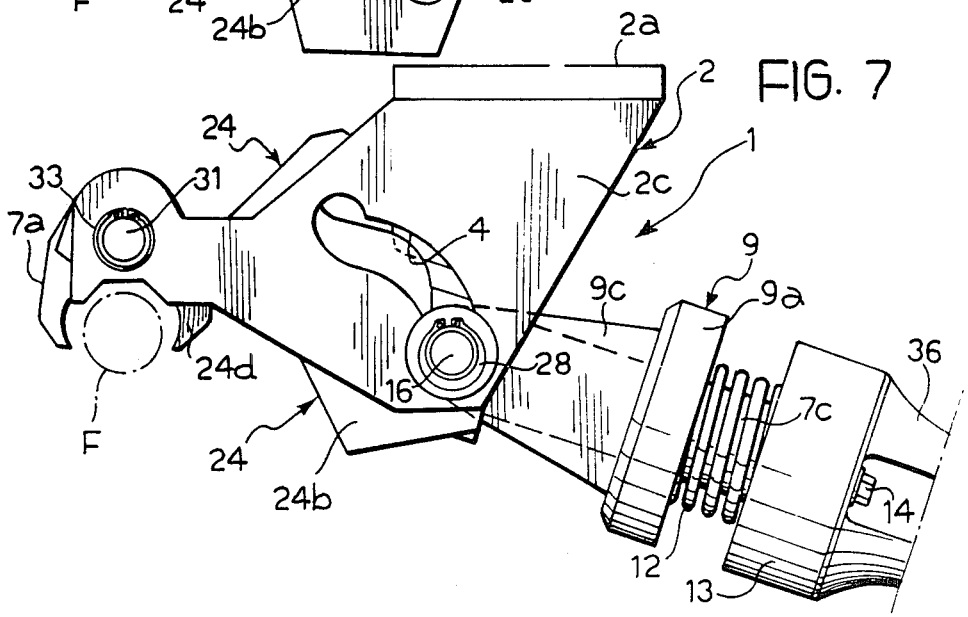
Figure 5:
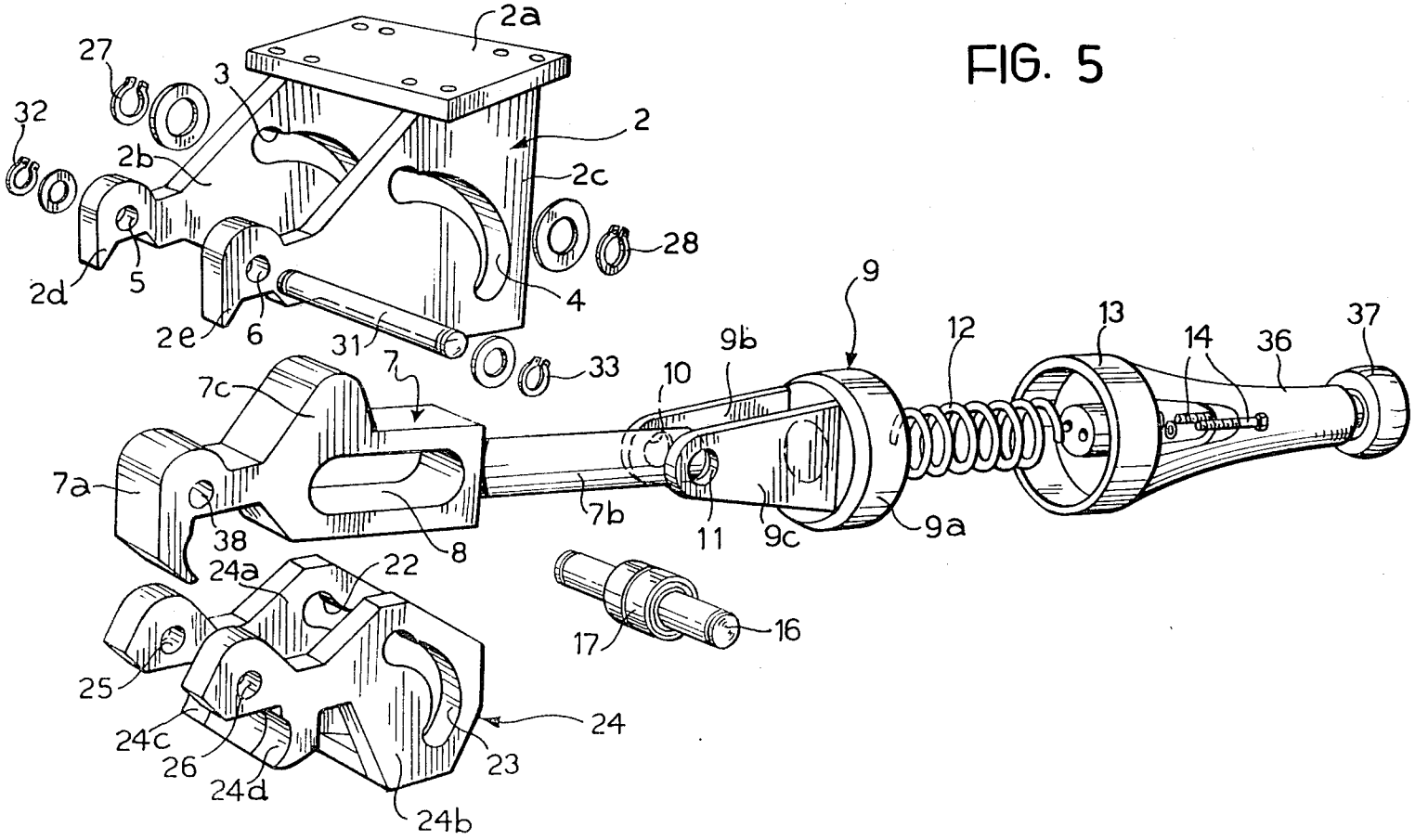

Further characteristics and advantages of the present invention will become apparent from the description which follows with reference to the appended drawings provided purely by way of non-limiting example, in which:

FIG. 1 is a perspective view of a device according to the invention in the condition in which the jaws are open, FIG. 2 is a plan view of the device, FIG. 3 is a section taken on the line III—III of FIG. 2, FIG. 4 is a section taken on the line IV—IV of FIG. 3, FIG. 5 is an exploded perspective view of the device of the invention, FIG. 6 is a side view of the device in the position in which the jaws are closed, and FIG. 7 is a view similar to FIG. 6, in the position in which the jaws are open.

With reference to the drawings, a device for the automatic connection of a vehicle (not illustrated) to a cable F of a continuously moving cableway is generally indicated 1.

The device comprises a support member 2 having a fixing plate 2a for attachment to the support structure of the vehicle. This support structure, not illustrated in the drawings, comprises, in the case of a cable-car provided with only one support and traction cable, a beam arranged parallel to the cable, beneath one end of which is fixed the plate 2 and to the other end of which is fixed the corresponding plate of a connection device identical to that which will now be described; the upper end of the suspension arm of the car is fixed to the central part of this beam.

In the case of a cable-car provided with two support and traction cables alongside each other, however, the suspension arm of the car will be fixed to the central part of a frame comprising two longitudinal beams to the underside of which are fixed the plates 2 of two connecting devices.

The member 2 comprises a pair of plates 2b, 2c having respective arcuate slots 3, 4. The plates 2b and 2c are extended into two respective beaked ends 2d, 2e having respective through-holes 5 and 6.

An operating lever 7 is positioned between the two plates 2b and 2c in the assembled condition. At one end, this lever 7 carries a jaw 7a constituting the outer jaw of a clamp intended to engage the cable F. At this end is also formed a hole 38 perpendicular to the axis of the lever 7. The central part of the lever 7 has a longitudinal slot 8. At its end opposite the jaw 7a, the lever 7 has a cylindrical shank 7b. A fork 9 is freely slidable on the shank 7b and is constituted by an apertured plate 9a and two elongate plates 9b, 9c perpendicular to the plate 9a and having respective apertures 10 and 11 at their free ends.

A helical spring 12 is also mounted on the cylindrical shank 7b after the fork 9 and reacts between the surface of the movable plate 9a and the surface of a second plate 13 fixed by screws 14 to the free end of the shank 7b. The plate 13 is rigid with a support arm 36 for a rotatable roller 37. The roller 37 is intended to cooperate in known manner with a fixed profiled guide carried by an arrival and departure station for the vehicle.

A pin 16 is mounted in the apertures 10 and 11 in the plates 9b, 9c of the fork 9. On the central part of the pin 16 is a rolling bearing 17 the outer ring of which engages the slot 8. In the assembled condition, respective ends of the pin 16 engage in the slots 3 and 4 in the two plates 2b and 2c of the support member 2. The pin 16 also engages in slots 22, 23 formed in two plates 24a and 24b forming part of an intermediate rocker arm, generally indicated 24. The two plates 24a and 24b each have a half-jaw, indicated 24c and 24d respectively, at their ends opposite those with the slot; the two half-jaws 24c, 24*d* are aligned with each other and constitute the outer jaw of a clamp for engaging the cable F.

The two plates 24*a* and 24*b* also each have an aperture, indicated 25 and 26 respectively, above the half-jaws 24*c* and 24*d*.

The pin 16 is retained axially relative to the plates 2*b* and 2*c* by two Seeger rings 27 and 28.

The operating lever 7 and the intermediate rocker arm 24 are articulated to the support member 2 by means of a pin 31 inserted in the apertures 5, 6, 38, 25, and 26 and held in position by a pair of Seeger rings 32 and 33.

The operating lever 7 also has an upper projection 7*c* in order to allow the clamp to be opened at a station should the normal opening device fail to operate.

The arcuate slots 3, 4, 22, 23 have central profiled cam portions; the profile is such that, in operation, the forces on the various parts of the device are small. This profile also enables a clamping force to be exerted on the cable by the two jaws 7*a* and 24*c*, 24*d* which is constant at any point of its travel: thus, the clamping force on the cable will remain the same whatever the diameter of the cable.

The device described above operates in the following manner.

When the vehicle carried by the support and traction cable F approaches a station, the device is in the condition of FIG. 6, in which the jaws 7*a* and 24*c*, 24*d* are clamped on the cable F. The pin 16 is at the end of its travel at the upper end of the slots 3, 4, 22 and 23.

The bearing 17 for the pin 16 is in the left-hand part of the slot 8 (with reference to FIG. 3) so that the spring 12 is under a light load between the plates 3*a* and 13.

The condition of opening of the jaws, shown in FIGS. 1 and 7, is achieved when the vehicle enters the station as a result of the contacts of the roller with the fixed profiled guide which lowers the operating lever 7 to bring the pin 6 to the lower end of the slots 3, 4, 22 and 23 and the bearing 17 into the right-hand part of the slot 8, thus loading the spring 12 as a result of the movement of the movable plate 9*a* towards the right.

In moving from their closed position to their open position, the jaws go through the following three phases.

The first phase corresponds to the disengagement of the pin 6 from the upper end of the slots 3 and 4 (with reference to the drawings). In this phase, the two jaws, the outer one 7*a* and the inner one 24*c*, 24*d*, open simultaneously. A further lowering of the operating lever 7 carries the pin 6 into the intermediate portion of the slots 3, 4, 22, 23: this condition is shown in FIG. 3. In this phase (as a result of the particular conformation of the two pairs of slots 3, 4 and 22, 23) the inner half-jaws 24*c* and 24*d* remain stationary, while only the outer jaw 7*a*, which is rigid with the lever 7, continues to open.

The final phase, corresponding to a further lowering of the lever 7 which brings the pin 6 to the lower end of the two pairs of slots, causes further simultaneous separation of the outer jaw 7*a* and the two inner half-jaws 24*c* and 24*d*.

As the vehicle leaves the station, the roller 37 leaves the fixed profiled guide and the helical spring 12 urges the fork 9, and hence the pin 16, towards the position in which the jaws are closed, shown in FIG. 6. The clamping of the jaws occurs in the opposite sequence from the phases described previously: in a first phase, the two jaws move together at the same speed; in the second phase, clamping onto the cable F occurs as a result solely of the movement of the outer jaw 7*a* (while the two inner half-jaws 24*c* and 24*d* remain stationary); finally, in the third phase, both the outer and inner jaws 7*a* and 24*c*, 24*d* effect a further clamping movement.

The device described above has considerable advantages over the clamps used until now for the automatic connection of a vehicle to the cable of a continuously moving cableway.

Essentially, the limited number of component parts gives it an extremely small bulk. Moreover, the particular conformation of the cam profiles of the slots 3, 4, 22, 23, by virture of which the movement of the jaws occurs in the phases described above, enables the forces on all the parts, particularly the lever 7, to be reduced considerably, as already noted.

Moreover, the fact that the clamping force exerted on the cable is independent of the diameter of the cable is a considerable advantage in view of the fact that the diameters of the cables of cableways reduce with time because of the contraction of the textile core; on the other hand, in the zone of joining of the cable, commonly called the splicing, the diameter is slightly greater than that of the cable.

I claim:

1. A device for the automatic connection of a vehicle having a suspension system to a cable or to each of two cables of a continuously moving cableway, of the type comprising a clamp constituted by inner and outer movable jaws carried by the upper end of the vehicle suspension system, resilient means for closing the clamp so that it automatically engages the cable, and cam means located at each station of the cableway for automatically opening the clamp and simultaneously loading the resilient means, so as to cause the temporary unhooking of the vehicle from the cable on its arrival at a said station and the closure of the clamp on the departure of the vehicle from the station, wherein the device further includes:

an operating lever which carries the outer movable jaw and defines an axial slot, the lever being operated directly by the cam means located at the station;

a support member to which the operating lever is pivoted and which includes two parallel plates defining cam slots and fixable to the vehicle structure;

a pin on which the operating lever is pivoted to the support member;

a cylindrical shank carried by the end of the operating lever opposite that carrying the outer movable jaw;

a helical spring carried by said shank;

a fixed plate against which one end of the spring reacts;

a movable plate slidable on the shank and against which the other end of the spring reacts;

a fork fixed to the movable plate;

a pin supported by the fork and slidable in the axial slot in the operating lever so that the pivoting of the operating lever in the sense corresponding to opening of the clamp, which is driven by the cam means at the station, causes the simultaneous outward pivoting of the respective jaw and loading of the spring, respective ends of the pin supported by the fork engaging in the cam slots defined by the two parallel plates of the support member;

two aligned half-jaws constituting the inner movable jaw;

an intermediate rocker arm including two plates which carry the half-jaws, the rocker arm being pivoted to the support member on the same pin as the operating lever and being located between the operating lever and the two plates of the support member, and respective cam slots defined by the plates of the intermediate rocker arm and having shapes concordant with those of the slots of the support member, the cam slots being passed through by the pin supported by the fork.

2. A device according to claim 1, wherein the profiles of the cam slots of the support member and the cam slots of the intermediate rocker arm are such that, as a result of the movement of the pin supported by the fork caused by the pivoting of the operating lever, they cause the following sequence of movements in the phase of opening of the jaws:

(a) simultaneous opening of the two jaws, (b) arresting of the angular movement of the inner jaw and continuance of the opening movement of the outer jaw, and (c) further simultaneous opening of the two jaws, and the following sequence of movements in the phase of closure of the jaws:

(d) simultaneous closure of the two jaws, (e) arresting of the angular movement of the inner jaw and continuance of the closing movement of the outer jaw, and (f) further simultaneous closure of the two jaws.

* * * * *